US009522542B2

(12) United States Patent
Scholz et al.

(10) Patent No.: US 9,522,542 B2
(45) Date of Patent: Dec. 20, 2016

(54) SPOT COLOR ENHANCEMENT IN A DIGITAL INKJET PRESS

(71) Applicant: Memjet Technology Ltd., Dublin (IE)

(72) Inventors: Marcus Scholz, San Diego, CA (US); Yvette Durham, San Diego, CA (US)

(73) Assignee: Memjet Technology Limited (IE)

( * ) Notice: Subject to any disclaimer, the term of this patent is extended or adjusted under 35 U.S.C. 154(b) by 0 days.

(21) Appl. No.: 14/996,151

(22) Filed: Jan. 14, 2016

(65) Prior Publication Data

US 2016/0229195 A1 Aug. 11, 2016

Related U.S. Application Data

(60) Provisional application No. 62/114,009, filed on Feb. 9, 2015.

(51) Int. Cl.
*B41J 2/21* (2006.01)

(52) U.S. Cl.
CPC ..... *B41J 2/2103* (2013.01)

(58) Field of Classification Search
CPC ..... G06K 15/102; B41J 2/2132; B41J 2/2107; B41J 2/2103
See application file for complete search history.

(56) References Cited

U.S. PATENT DOCUMENTS 5,057,852 A * 10/1991 Formica ..... B41J 2/2103 347/40
5,992,971 A * 11/1999 Takahashi ..... B41J 2/2107 347/14
7,641,310 B2 * 1/2010 Tsuchiya ..... H04N 1/54 347/15

* cited by examiner

*Primary Examiner* — Thinh H Nguyen
(74) *Attorney, Agent, or Firm* — Cooley LLP

(57) ABSTRACT

A method of enhancing spot color printing in a digital inkjet press having a fixed number of monochrome inkjet printheads, the fixed number of monochrome inkjet printheads printing inks comprising at least process colors (CMY) and a spot color, the method comprising the steps of: (a) printing a process color combination comprising a predetermined ratio of at least two process colors, the process color combination approximating the spot color; and (b) printing the spot color with the process color combination to provide an enhanced spot color.

13 Claims, 1 Drawing Sheet

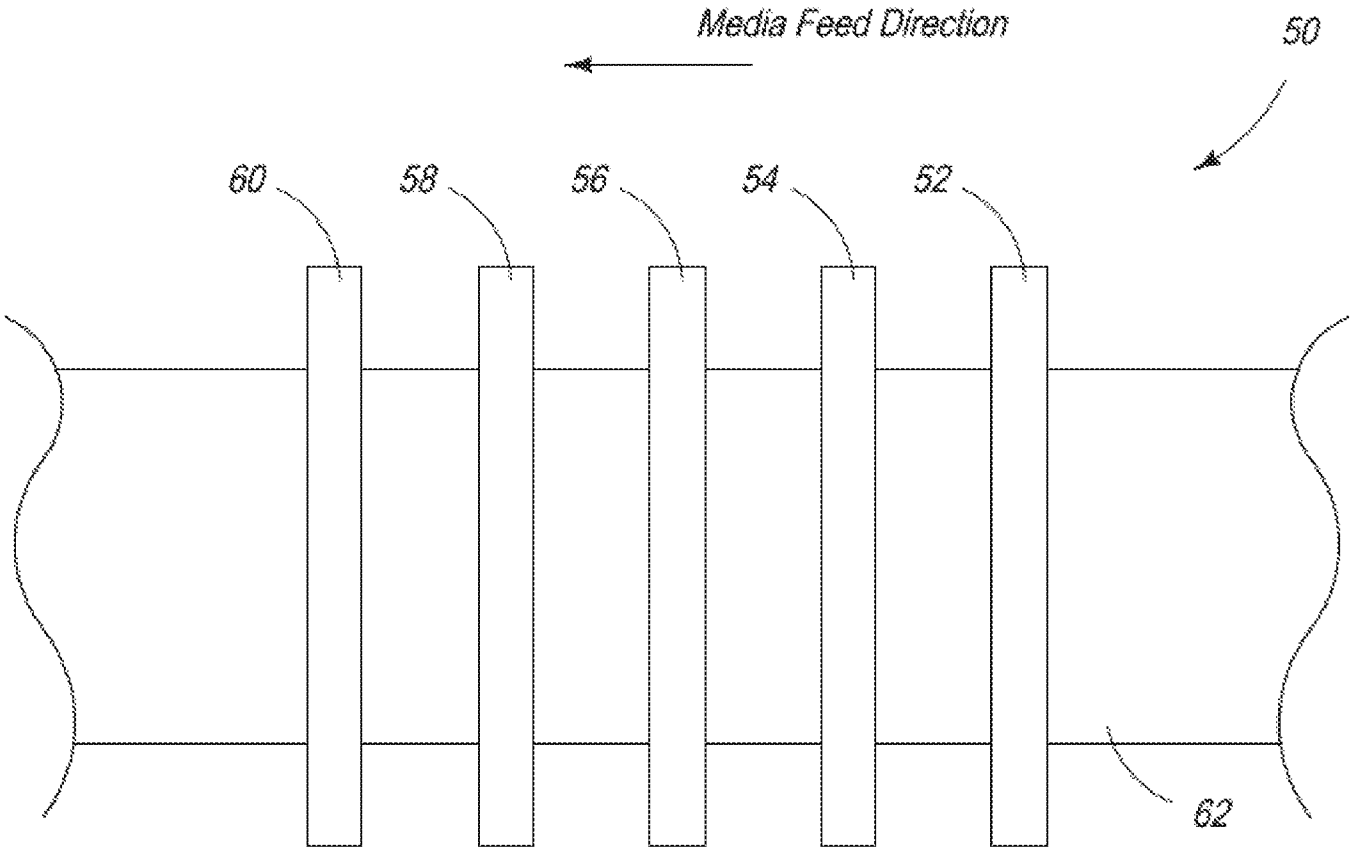
50
Media Feed Direction
52
54
56
58
60
62

SPOT COLOR ENHANCEMENT IN A DIGITAL INKJET PRESS

FIELD OF THE INVENTION

This invention relates to a method of printing. It has been developed primarily for enhancing a spot color in a digital inkjet press having a limited number of monochrome printheads.

BACKGROUND OF THE INVENTION

In U.S. Pat. No. 8,529,014, the contents of which are incorporated herein by reference, there was described a digital inkjet press comprised of a plurality of fixed monochrome printheads, which are aligned with each other in a media feed direction. Printing systems of this type are increasingly being used for relatively short print runs as an alternative to traditional analog printing presses. Digital printing advantageously obviates the creation of unique offset printing plates for each print job and reduces overall printing costs, especially in relatively short print runs.

In the printing system described in U.S. Pat. No. 8,529,014, there are provided five monochrome printheads, which can be plumbed with any required ink combination. As used herein, the term 'blade' is used to refer to a monochrome printhead and its associated ink delivery system. For pure monochrome printing at high speeds, the five blades may be configured as KKKKK; for typical color printing, the five blades may be configured as CMYKK—the two black channels enhancing black optical density; for customers with particular color requirements, the five blades may be configured as CMYKS, where S is a spot color, such as orange.

Customers are generally sensitive to the appearance of spot colors in, for example, labels and marketing materials. For example, a customer may have a brand association with a particular color which needs to be reproduced consistently in materials generated by both analog and digital printing techniques. Consistent color reproduction involves not only matching color, but also matching the perceived vividness of the color. However, digital inkjet presses, such as the printing system described in U.S. Pat. No. 8,529,014, have limitations, which make it difficult to provide a spot color that matches a corresponding analog spot color. Firstly, inkjet ink formulations have a limit on the maximum colorant loading useable in inks. With high colorant loadings, inkjet nozzles, as well as associated ink delivery and maintenance systems, can be become clogged with ink. Secondly, digital inkjet presses may have a limited and fixed number of blades, as defined by the architecture of the printing system. It would be convenient to simply add another spot color blade to compensate for the relatively lower colorant loading in inkjet inks; however, in the fixed five blade printing system described in U.S. Pat. No. 8,529,014, an additional spot color blade (e.g. CMYSS) would undesirably restrict the overall color gamut of the printer. Alternatively, a higher density of spot color may be achieved with slower print speeds, but slower printing speeds are obviously disadvantageous from most customers' standpoint.

It would therefore be desirable to provide a method of printing from a digital inkjet press, which improves on existing approaches to reproduction of spot colors, such as orange.

SUMMARY OF THE INVENTION

The present invention provides a method of enhancing spot color printing in a digital inkjet press having a fixed number of monochrome inkjet printheads, the fixed number of monochrome inkjet printheads printing inks comprising at least process colors (CMY) and a spot color, said method comprising the steps of:

printing a process color combination comprising a predetermined ratio of at least two process colors, the process color combination approximating the spot color; and printing the spot color with the process color combination to provide an enhanced spot color.

The present invention advantageously enhances spot colors by providing extra chroma (or vividness) with only an imperceptible change in perceived hue. Furthermore, the present invention obviates additional blades of spot color in the printing system and/or slower print speeds in order to achieve this extra vividness.

In terms of the process color combination approximating the spot color, it is preferred that the process color combination has a similar hue angle to the spot color. In conventional L*C*h* color space, the spot color has a hue angle of $h_1$*, and the process color combination has a hue angle of $h_2$*. Preferably, the process color combination and spot color meet the requirement of $-10° \leq h_1^* - h_2^* \leq +10°$, more preferably $-5° \leq h_1^* - h_2^* \leq +5°$.

Preferably, the process color combination and spot color meet the requirement $-20 \leq L_1^* - L_2^* \leq +20$, where the spot color has a lightness value defined by $L_1$* and the process color combination has a lightness value defined by $L_2$. More preferably, $-10 \leq L_1^* - L_2^* \leq +10$.

Preferably, $C_3^* > C_1^*$, where the spot color has a chroma value defined by $C_1$* and the enhanced spot color has a chroma value defined by $C_3$*.

The printing order may be selected to optimize color matching between the enhanced spot color and the spot color. For example, the spot color may be overprinted or underprinted relative to the at least two process colors. Alternatively, the spot color may be printed between the at least two process colors. The optimal printing order may be determined empirically.

In one embodiment, the spot color is orange and the process colors are magenta and yellow. Traditionally, vivid oranges are difficult to achieve with a standard CMYK ink set and often require spot colors in situations where consistent color reproduction is important.

Preferably, the digital inkjet press comprises a plurality of stationary inkjet printheads aligned in a media feed direction for single-pass printing.

Preferably, the digital inkjet press comprises a maximum of five printheads.

Preferably, the digital inkjet press is as described in U.S. Pat. No. 8,529,014, the contents of which are herein incorporated by reference.

In one embodiment, the digital inkjet press consists of a cyan (C), a magenta (M), a yellow (Y), a black (K) and a spot color (S) printhead.

Preferably, the spot color is printed at 100% laydown and the process color combination is printed at 100% laydown. Accordingly, the spot color is effectively printed at 200% laydown to provide extra vividness with minimal impact on hue.

The ratio of process colors is predetermined to approximate the spot color. For example, an orange spot color may be approximated by printing a predetermined ratio of magenta and yellow inks e.g. 20% magenta (M) and 80% yellow (Y).

Preferably, each ink has a colorant loading of less than 8 wt. %, less than 7 wt. % or less than 6 wt. %. The colorant may be a dye or a pigment.

Preferably, each ink is an aqueous-based inkjet ink.

BRIEF DESCRIPTION OF THE DRAWINGS

A specific embodiment of the present invention will now be described by way of example only with reference to the accompanying drawing, in which:

FIG. 1 is a schematic plan view of a digital inkjet press.

DETAILED DESCRIPTION OF THE INVENTION

Referring to FIG. 1, there is shown, schematically, a digital inkjet press 50 comprising five fixed monochrome inkjet printheads 52, 54, 56, 58 and 60 aligned with each other along a media feed direction. It will be appreciated that the printheads 52, 54, 56, 58 and 60 may be plumbed with any suitably colored inks. In the embodiment shown, the first printhead 52 is supplied with yellow (Y) ink, the second printhead 54 is supplied with an orange spot (S) ink, the third printhead 56 is supplied with cyan (C) ink, the fourth printhead 58 is supplied with magenta (M) ink, and the fifth printhead 60 is supplied with black (K) ink. Each printhead typically has multiple rows of nozzles (not shown), with each nozzle row printing the same colored ink to provide a monochrome printhead.

A web of print media 62 is fed in single pass past each of the printheads in the media feed direction as shown using a suitable media feed mechanism. This type of printer, which is described in more detail in U.S. Pat. No. 8,529,014, is capable of printing at very high speeds, such as speeds greater than 0.5 meters per second, or greater than 1 meter per second.

Conventionally, spot colors are employed to replicate a particular color, consistent with a customer's requirements. For the purposes of this discussion, it is assumed that the customer requires blocks of a vivid orange color to be printed on labels in accordance with specific color requirements. To this end, the second printhead 54 is dedicated to printing a specially formulated orange, which meets the customer's color requirements.

However, at 100% laydown, the printed orange is lighter and duller than labels printed by a traditional offset printing press. Therefore, in order to increase the vividness of the printed orange, the spot color is co-printed with a process orange comprising a combination of 80% yellow and 20% magenta. With the ordering of printheads described above, the spot color is sandwiched between the yellow and magenta inks during the printing process. The yellow, magenta and process orange inks each have a dye-loading of about 5 wt. %.

In accordance with a preferred embodiment, as described above, the process color combination and the spot color meet the requirements of:

$$-10 \leq h_1^* - h_2^* \leq +10; \text{ and}$$

$$-20 \leq L_1^* - L_2^* \leq +20.$$

The ratio of yellow and magenta is selected to match, as closely as possible, the customer's spot color (orange). In this particular example, the spot color has a hue angle of about 43° while the process orange has a hue angle of about 50°. The resultant printed orange has increased vividness or chroma compared to the pure spot color (i.e. $C_3^* > C_1^*$), whilst the inevitable change in hue is virtually imperceptible to the human eye.

Accordingly, the present invention provides an excellent balance between vividness (or chroma) and hue without changing the architecture or plumbing arrangement of the digital inkjet press 50, and without compromising print speeds.

It is particularly advantageous that increased chroma is achieved using inks having a relatively low colorant loading.

It will, of course, be appreciated that the present invention has been described by way of example only and that modifications of detail may be made within the scope of the invention, which is defined in the accompanying claims.

The invention claimed is:

1. A method of enhancing spot color printing in a digital inkjet press having a fixed number of monochrome inkjet printheads, the fixed number of monochrome inkjet printheads printing inks comprising at least process colors (CMY) and a spot color, said method comprising the steps of:

printing a process color combination comprising a predetermined ratio of at least two process colors, the process color combination approximating the spot color; and printing the spot color with the process color combination to provide an enhanced spot color, wherein:

the spot color has a hue angle defined by h1*;

the process color combination has a hue angle defined by h2*; and $$-10° \leq h1^* - h2^* \leq +10°.$$

2. The method of claim 1, wherein:

the spot color has a lightness value defined by L1*;

the process color combination has a lightness value defined by L2*; and $$-20 \leq L1^* - L2^* \leq +20.$$

3. The method of claim 1, wherein:

the spot color has a chroma value defined by C1*;

the enhanced spot color has a chroma value defined by C3*; and $$C3^* > C1^*.$$

4. The method of claim 3, wherein the digital inkjet press comprises a maximum of five printheads.

5. The method of claim 1, wherein the spot color is overprinted or underprinted relative to the at least two process colors.

6. The method of claim 1, wherein the spot color is printed between the at least two process colors.

7. The method of claim 1, wherein the spot color is orange and the process colors are magenta and yellow.

8. The method of claim 1, wherein the digital inkjet press comprises a plurality of stationary inkjet printheads aligned in a media feed direction.

9. The method of claim 8, wherein the digital inkjet press consists of cyan (C), magenta (M), yellow (Y), black (K) and spot color (S) printheads.

10. The method of claim 1, wherein the spot color is printed at 100% laydown and the process color combination is printed at 100% laydown.

11. The method of claim 1, wherein each ink has a colorant loading of less than 8 wt. %.

12. The method of claim 11, wherein each ink is an aqueous-based inkjet ink.

13. The method of claim 1, wherein the spot color is not black.

* * * * *